US010306996B1

(12) United States Patent
Sima

(10) Patent No.: US 10,306,996 B1
(45) Date of Patent: Jun. 4, 2019

(54) MULTI-PURPOSE CHILDREN'S FURNITURE

(71) Applicant: Michael Sima, Lombard, IL (US)

(72) Inventor: Michael Sima, Lombard, IL (US)

(73) Assignee: Michael Sima, Lombard, IL (US)

( * ) Notice: Subject to any disclaimer, the term of this patent is extended or adjusted under 35 U.S.C. 154(b) by 0 days.

(21) Appl. No.: 15/976,978

(22) Filed: May 11, 2018

(51) Int. Cl.

| | |
|---|---|
| ***A47L 15/50*** | (2006.01) |
| ***A47D 11/00*** | (2006.01) |
| ***A47D 3/00*** | (2006.01) |
| ***A47C 12/00*** | (2006.01) |
| ***B43L 1/04*** | (2006.01) |
| ***B43L 1/00*** | (2006.01) |
| ***B43L 1/06*** | (2006.01) |
| ***B43L 1/10*** | (2006.01) |
| *A47D 1/00* | (2006.01) |

(52) U.S. Cl.
CPC ..... *A47D 11/00* (2013.01); *A47C 12/00* (2013.01); *A47D 3/00* (2013.01); *B43L 1/008* (2013.01); *B43L 1/045* (2013.01); *B43L 1/06* (2013.01); *B43L 1/10* (2013.01); *A47D 1/0085* (2017.05); *A47D 11/002* (2013.01)

(58) Field of Classification Search
CPC ..... A47D 11/00; A47D 11/002; A47D 3/00; A47D 1/0085; A47C 12/00; B43L 1/008; B43L 1/045; B43L 1/06; B43L 1/10
See application file for complete search history.

(56) References Cited

U.S. PATENT DOCUMENTS

| | | | | |
|---|---|---|---|---|
| 2,554,851 A * | 5/1951 | Borthwick | A47D 1/006 297/129 |
| 3,206,266 A * | 9/1965 | Holloway | A01K 97/06 312/216 |
| 3,367,712 A * | 2/1968 | Greene | A47C 12/02 182/33.3 |
| 3,556,586 A * | 1/1971 | Beardmore | A47B 83/02 297/118 |
| 3,570,418 A * | 3/1971 | Gooding | A47C 4/022 108/12 |
| 3,575,465 A * | 4/1971 | Dolby | A47B 83/00 206/821 |
| 3,592,506 A * | 7/1971 | Breslow | A47D 1/04 297/1 |

(Continued)

FOREIGN PATENT DOCUMENTS

| | | |
|---|---|---|
| CN | 201256759 Y | 2/1987 |
| CN | 201591372 U | 9/2010 |
| GB | 147953 | 4/1969 |

*Primary Examiner* — Hanh V Tran
(74) *Attorney, Agent, or Firm* — Beem Patent Law Firm

(57) ABSTRACT

A combination desk-step stool furniture piece may provide a portable and/or easy-to-use tool to help children reach elevated objects and have a desk and chair to foster their creative minds or however else they see fit to use it. The piece may include a support frame having a plurality of legs that define a footprint and an upper step and at least one intermediate step. One or more of the steps may lie substantially within the footprint. The upper step and/or the intermediate step may be textured to provide traction to facilitate use of the furniture piece as a step stool. The piece also may include a removable table top that may be attached to the upper step. The frame also may include a storage compartment for stowing the tabletop when the furniture is not being used as a desk. Other embodiments and features also are described.

20 Claims, 7 Drawing Sheets

(56) References Cited

U.S. PATENT DOCUMENTS

| | | | | | |
|---|---|---|---|---|---|
| D242,423 | S | * | 11/1976 | Culligan | D34/1 |
| 4,205,876 | A | * | 6/1980 | Cetina | A47D 1/00 297/118 |
| 4,527,830 | A | * | 7/1985 | Meyers | A47D 11/002 297/17 |
| 4,645,261 | A | | 2/1987 | Bourne et al. | |
| 5,085,486 | A | * | 2/1992 | Johnson | A47D 13/105 297/158.3 |
| D330,462 | S | * | 10/1992 | Szablak | D6/350 |
| D354,210 | S | * | 1/1995 | Dickinson | D25/63 |
| 5,423,597 | A | * | 6/1995 | Rogers | A47B 39/00 297/135 |
| 5,641,034 | A | * | 6/1997 | Calmeise | A47C 12/00 182/17 |
| 6,309,016 | B1 | * | 10/2001 | Aloisi | A47C 7/002 108/92 |
| D512,537 | S | * | 12/2005 | Barnes | D30/119 |
| D653,043 | S | * | 1/2012 | Rumley | D6/338 |
| D685,147 | S | * | 6/2013 | Muir | D30/118 |
| 2001/0049842 | A1 | * | 12/2001 | Fenty | A47D 11/00 5/93.2 |
| 2003/0221593 | A1 | * | 12/2003 | Usagani | A47B 85/00 108/59 |
| 2004/0237857 | A1 | * | 12/2004 | Refsum | A47B 9/14 108/180 |
| 2007/0262622 | A1 | * | 11/2007 | Tally | A47C 12/00 297/183.3 |
| 2008/0257280 | A1 | * | 10/2008 | Jakubowski | A01K 1/035 119/849 |
| 2016/0174700 | A1 | * | 6/2016 | Brandenberg | A47B 47/04 5/93.1 |
| 2018/0116423 | A1 | * | 5/2018 | Warjanka | A47D 1/0085 |
| 2018/0222246 | A1 | * | 8/2018 | Martin | B43L 1/008 |

* cited by examiner

MULTI-PURPOSE CHILDREN'S FURNITURE

BACKGROUND OF THE INVENTION

1. Technical Field

The present application relates to children's furniture and more particularly to furniture that may serve multiple purposes, such as acting as a step stool, chair, desk, art station, and the like.

2. Related Art

Children, and especially toddlers, amass stuff. Toys, clothes, books, videos, and the like accumulate from infancy as parents, grandparents, family and friends provide an endless stream of gifts to nurture and support the rapidly developing child. Furniture is no exception. Cribs, beds, rocking chairs, changing tables, wardrobes, toy chests, and the like. The smallest member of the household often takes a disproportionately large share of the space.

To address these problems, some convertible furniture have been developed to provide multiple functions with the same materials. However, these pieces suffer from problems of their own. For example, they are usually large, cumbersome and/or complex, making them difficult and potentially dangerous for use by children. For example, when in typical step stool configurations, these devices usually provide an upper step positioned nearly directly overtop a intermediate step, making it difficult for a toddler still adapting to her new movement abilities to reach the top step. Similarly, it typically requires significant effort, precision, or both to properly configure these pieces as tables or desktops, well beyond the capabilities of a toddler. Even if a parent or other adult is able to re-configure the furniture in such a configuration, the resulting table or desk is either difficult to use, unstable, or both.

Accordingly, a need has long existed for convertible furniture that may be utilized by children and provides real utility in each of its various configurations.

SUMMARY

In one embodiment, a combination desk-step stool furniture piece may provide a portable and/or easy-to-use tool to help children reach elevated objects and have a desk and chair to foster their creative minds or however else they see fit to use it. The piece may include a support frame having a base that defines a footprint, an upper step and at least one intermediate step. One or more of the steps may lie substantially within the footprint, i.e. directly above the area defined by footprint. The upper step and/or the intermediate step may be textured to provide traction to facilitate use of the furniture piece as a step stool. The piece also may include a removable table top that may be attached to the upper step. The frame also may include a storage compartment for stowing the tabletop when the furniture is not being used as a desk.

Other systems, methods, features and advantages of the invention will be, or will become apparent to one with skill in the art upon examination of the following figures and detailed description. It is intended that all such additional systems, methods, features and technical advantages be included within this description, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention.

DETAILED DESCRIPTION OF THE PREFERRED EMBODIMENTS

The elements illustrated in the Figures interoperate as explained in more detail below. Before setting forth the detailed explanation, however, it is noted that all of the discussion below, regardless of the particular implementation being described, is exemplary in nature, rather than limiting.

1.0 Convertible Furniture Overview

Figure 1:
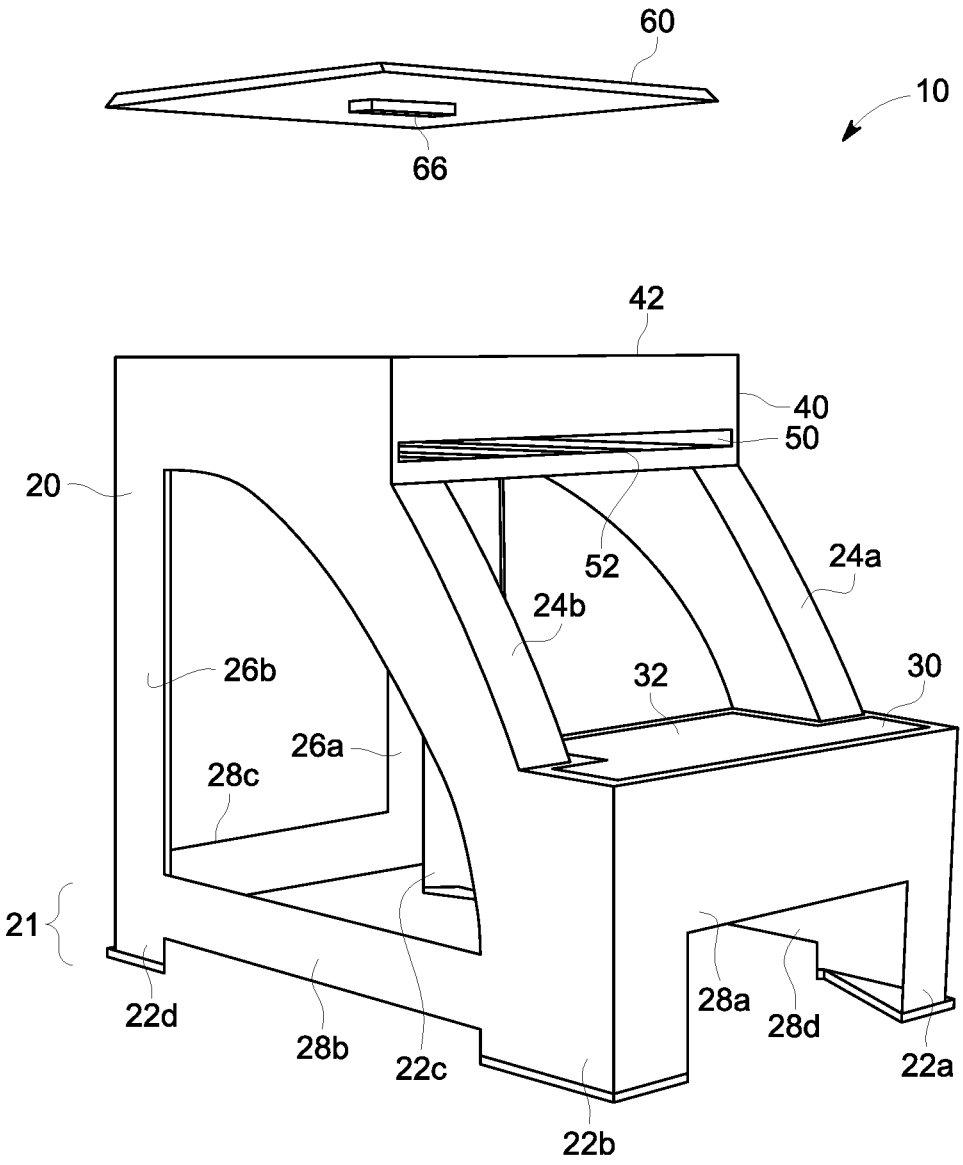
FIG. 1 shows a perspective view of an exemplary convertible furniture piece.

Referring to the drawings, and initially to FIG. 1, an exemplary convertible furniture piece 10 is shown. The convertible furniture piece 10 may include a body 20 that includes a base portion 21, an upper step 40, and an intermediate step 30. The upper step 40 may be used in conjunction with the intermediate step 30 to enable a child or other person to use the furniture 10 as a step-stool. In this manner, the convertible furniture piece 10 allows children to reach items higher than their bodies alone can reach, such as a sink for washing their hands or brushing their teeth. In addition, a table top 60 also may be provided. The table top 60 may be removably attached to the upper step 40 so that the child may use the furniture as a desk or workspace. In such a configuration, a child may use the intermediate step 30 as a seat so that the furniture acts as a unitary desk/workstation.

The components of furniture piece 10 may be made of any suitable material. For example, rigid or semi-rigid materials such as plastics or thermoplastic material such as acrylonitrile butadiene styrene (ABS), wood, rubber, metal and the like may be used. The components may be made of the same material, or different components may be made using different materials or combinations of materials. The piece 10 as a whole may be made of a unified construction, subsets of components made of a unified construction, or each component may be separately constructed. The body 20 may be translucent or opaque, clear or colored. Preferably, the body 20 is made of any suitable rigid material that may support the weight of a toddler, or in some embodiments, the weight of an adult.

2.0 Exemplary Base Portions 21

The body 20 may include a base portion 21 that defines a footprint for the convertible furniture piece 10. In some embodiments, the base portion 21 may include one or more feet 22*a-d* that may be interconnected. For example, in the illustrated embodiment, the base portion 21 includes four feet 22*a-d* interconnected by lateral supports 28*a-d*. Preferably, the footprint is large enough to accommodate substantially all of either the upper step 40, the intermediate step 30, or both. In addition, the interior of the convertible piece 10 preferably may be relatively free from obstruction so that the when the child is using the intermediate step 30 as a chair, the piece 10 can accommodate the child's legs without much restriction. For example, in the illustrated embodiment, the frame 20 does not include cross-beams or the like that obstruct the interior of the convertible piece 10. In other words, the frame 20 in the illustrated embodiment only consists of components disposed on a perimeter of the piece.

In some embodiments, dimensions of the convertible furniture piece 10 may be as follows: the width of the footprint (e.g. distance between feet 22*a* and 22*b*) of the convertible furniture piece 10 may be between about 8 inches and about 20 inches, preferably between about 10 inches and about 18 inches, and even more preferably between about 12 inches and about 16 inches; the length of the footprint (e.g. distance between feet 22*b* and 22*d*) of the convertible furniture piece 10 may be between about 10 inches and about 22 inches, preferably between about 13 inches and about 19 inches, and even more preferably between about 15 inches and about 17 inches; and the height of the convertible furniture piece 10 may be between about 12 inches and about 24 inches, preferably between about 15 inches and about 21 inches and even more preferably between about 17 inches and about 19 inches. These sizes typically allow the convertible furniture piece 10 to be small enough to be stowed away while also being large enough to accommodate most toddlers' needs as a stool and/or as a chair/workspace combination. In the illustrated embodiment, the overall footprint of the convertible furniture piece 10 is about 14 inches by about 16 inches and the height is about 18 inches. Other sizes may also be used. Alternatively, or additionally, the convertible furniture piece 10 may be sold in various sizes, such as extra small, small, medium, large, and extra-large and/or in various colors. In some embodiments, different colors may be used for different components of the accessory.

Optionally, the bottom of the base portion 21 may be made of a material having a suitable coefficient of friction to impede movement or slippage of the convertible furniture piece 10 during normal use (also referred to herein as a "non-slip" surface or material). For example, in the illustrated embodiment, each foot 21*a-d* has a corresponding non-slip material 23*a-d* applied to its underside. Alternatively or additionally, such a material may be attached to or applied to only certain portions of the bottom base 21.

3.0 Exemplary Intermediate Step 30

The intermediate step 30 may be attached to the base portion 21. Preferably, the intermediate step 30 is fixedly attached to the base 21. For example, in the illustrated embodiment, the intermediate step 30 is fixedly attached to feet 22*a* and 22*b* of the base 21 by legs 26*a* and 26*b*. In some embodiments, substantially all of the intermediate step 30 is positioned directly above the footprint defined by the base 21. Stability of the piece 10 is increased by keeping substantially all of the intermediate step 30 directly above the footprint of the base 21 and/or by fixedly attaching the intermediate step 30 to the base 21. This stability increase may be realized either when the intermediate step 30 is used as a step or as a seat.

In addition, the intermediate step 30 also may be attached to the upper step 40, and preferably is fixedly attached to the upper step 40. In the illustrated embodiment, the intermediate step 30 is fixedly attached to the upper step 40 by upper supports 24*a* and 24*b*. Upper supports 24*a* and 24*b* provide a support structure for the upper step 40 and also may provide side rails that restrict the child's movement and reinforce proper usage of the intermediate step 30 as a seat. Children, and toddlers particularly, often sit precariously off-center in free standing seats, such as by sitting on the edge of a seat or positioning their weight other than directly atop the seat. By acting as rigid side rails, upper supports 24*a* and 24*b* encourage proper use of the convertible furniture piece 10 as a seat. In the illustrated embodiment, upper supports 24*a* and 24*b* are arched supports. Other shapes may be used.

The intermediate step 30 may be dimensioned to accommodate a child when being used as a step, as a seat, and preferably as both. For example, in some embodiments, dimensions of the intermediate step 30 may be as follows: the width of the intermediate step 30 may be between about 8 inches and about 20 inches, preferably between about 10 inches and about 18 inches, and even more preferably between about 12 inches and about 16 inches; the length of the intermediate step 30 may be between about 3 inches and about 14 inches, preferably between about 4.5 inches and about 10 inches, and even more preferably between about 6 inches and about 8 inches; and the intermediate step 30 may sit at a height of about 3 inches and about 15 inches, preferably between about 5 inches and about 12 inches and even more preferably between about 7 inches and about 9 inches. In addition, upper supports 24*a* and 24*b* may be between about 0.25 inches wide and about 3 inches wide, preferably between about 0.35 inches wide and about 2 inches wide, and even more preferably between about 0.45 inches wide and about 1 inch wide, and have a height between about 5 inches and about 12 inches, preferably between about 7 inches and about 10 inches, and even more preferably between about 8 inches and about 9 inches. Other sizes also may be used. In the illustrated embodiment, the intermediate step is about 14 inches wide, about 7 inches long and sits at a height of about 8 inches and upper supports 24*a* and 24*b* are about 0.5 inches wide and about 8.5 inches tall.

Optionally, the intermediate step 30 may include an upper surface 32 having a material with a suitable coefficient of friction to impede movement or slippage of during normal use (also referred to herein as a "non-slip" surface or material). Such a material may be attached to or applied to only certain portions of the intermediate step 30. For example, in the illustrated embodiment, each foot 21*a-d* has a corresponding non-slip material 32 applied to its underside.

4.0 Exemplary Upper Steps 34

Figure 2:
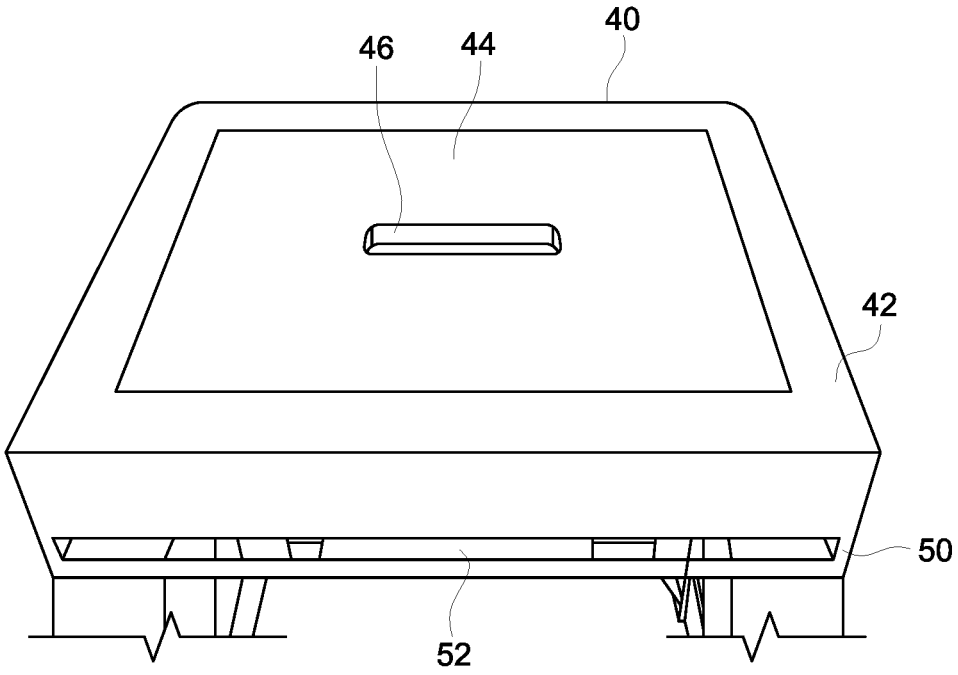
FIG. 2 shows a perspective view of a top portion of the exemplary convertible furniture piece of FIG. 1.

Referring to FIG. 2, a perspective view of an upper step 40 of the exemplary convertible furniture piece 10 of FIG. 1 is shown. The upper step 40 may include an upper surface 42 that may be substantially flat. Preferably, the upper step 40 is fixedly attached to the base 21. For example, in the illustrated embodiment, the upper step 40 is fixedly attached to feet 22*c* and 22*d* of the base 21 by legs 26*c* and 26*d*. In some embodiments, substantially all of the upper step 40 is positioned directly above the footprint defined by the base 21. Stability of the piece 10 is increased by keeping the substantially all of the upper step 40 directly above the footprint of the base 21 and/or by fixedly attached the upper step 40 to the base 21. These stability increases may be realized either when the upper step 40 is used as a step or as a desk/workstation.

As noted above, the upper step 40 also may be attached to the intermediate step 40, and preferably may be fixedly attached to the intermediate step 30. In the illustrated embodiment, the upper step 40 is fixedly attached to the intermediate step 30 by upper supports 24*a* and 24*b*, as described above.

In some embodiments, the upper surface 42 includes a textured surface 44, such as a material with a suitable coefficient of friction to impede movement or slippage of during normal use (also referred to herein as a "non-slip" surface or material). Such a material may be attached to or applied to only certain portions of the intermediate step 30. For example, in the illustrated embodiment, a non-slip material 44 is applied to most of the upper surface 42 of step 40, leaving an uncoated border around the textured surface 44.

The upper step 40 may be dimensioned to accommodate a child when being used as a step, as a desk/workstation, and preferably as both. For example, in some embodiments, dimensions of the upper step 40 may be as follows: the width of the upper step 40 may be between about 8 inches and about 20 inches, preferably between about 10 inches and about 18 inches, and even more preferably between about 12 inches and about 16 inches; the length of the upper step 40 may be between about 8 inches and about 20 inches, preferably between about 10 inches and about 18 inches, and even more preferably between about 12 inches and about 16 inches; and the upper step 40 may sit at a height of about 12 inches and about 32 inches, preferably between about 16 inches and about 28 inches and even more preferably between about 20 inches and about 24 inches. Other sizes also may be used. In the illustrated embodiment, the upper step 40 is about 13 inches wide, about 13 inches long and sits at a height of about 22 inches.

5.0 Exemplary Table Tops 60

Figure 3A:
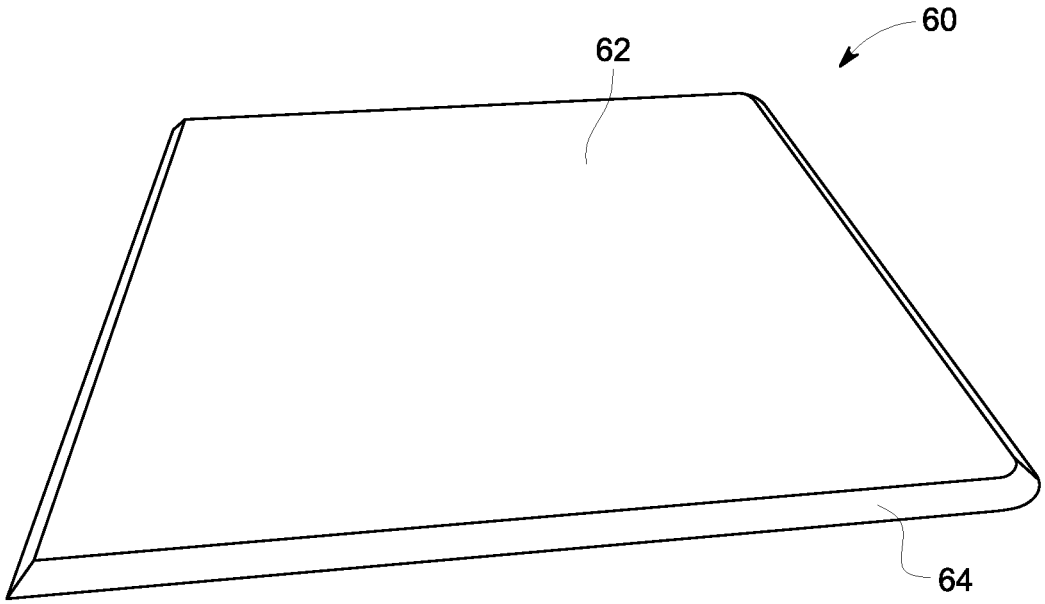
FIGS. 3A-B show perspective views of exemplary table tops for an exemplary convertible furniture piece.
Figure 3B:
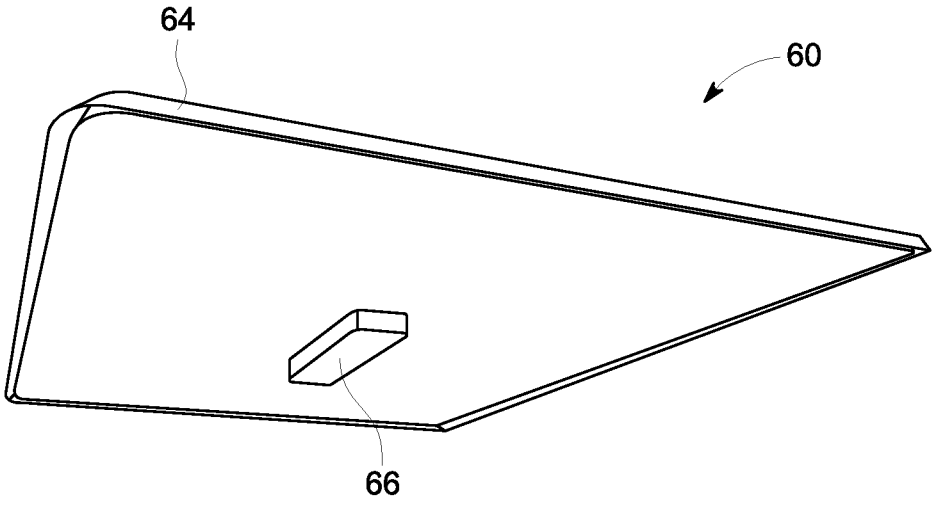

The table top 60 may be removably attached to the upper step 40 so that the child may use the furniture as a desk or workspace. FIGS. 3A-B show perspective views of an exemplary table top 60 for an exemplary convertible furniture piece 10. In the illustrated embodiment, the table top 60 may include a substantially flat upper surface 62 that provides a workspace for the child to use when the table top 60 is attached to the upper step 40. The table top 60 also may include a locking mechanism 66 that may engage a complimentary locking mechanism 46 on the upper step 40. As explained in more detail below, a variety of locking mechanism may be used.

The table top 60 may be made of a variety of materials to facilitate its use as a desk/workstation and/or its attachment to the upper step 40. For example, the table top 60 may be made of any suitable rigid or semi-rigid material, such as acrylic or the like. In some embodiments, the table top 60 is translucent so as to allow a user of the convertible furniture piece 10 to see the upper surface 42 of the upper step 40 even if the table top 60 is attached thereto. In other embodiments, the table top 60 may be opaque. In some embodiments, the table top 60 may include an upper surface 62 made from chalkboard, whiteboard, corkboard, or other materials so the child can write or otherwise directly interact with the table top 60. In some embodiments, the table top 60 may be made of or include pieces of ferromagnetic material to allow the child to attach magnetic objects to the table top 60. In still other embodiments, the table top 60 may include components for attaching interlocking building block or the like. Multiple table tops 60 may be provided for interchangeable use with a single body 20.

In some embodiments, the table top 60 may include indicia for facilitating learning or playing with the table top 60. For example, indicia may include numbers, letters, gridlines for measurements, games (such as tic-tac-doe, checkers and the like) and the like. The indicia may be, for example, printed or etched onto the table top 60. Other methods of placing indicia on the table top 60 also may be used.

The table top 60 may be dimensioned to cover all or a portion of the upper step 40. For example, in some embodiments, dimensions of the table top 60 may be as follows: the width of the table top 60 may be between about 8 inches and about 20 inches, preferably between about 10 inches and about 18 inches, and even more preferably between about 12 inches and about 16 inches; the length of the table top 60 may be between about 8 inches and about 20 inches, preferably between about 10 inches and about 18 inches, and even more preferably between about 12 inches and about 16 inches. Other sizes also may be used. In the illustrated embodiment, the table top 60 is about 13 inches wide, about 13 inches long.

6.0 Exemplary Locking Mechanisms

In some embodiments, the convertible furniture piece 10 may include a locking mechanism for securing the removably-attachable table top 60 to the upper step 40. For example, in the embodiment illustrated in FIGS. 1-2 and 3*a-b*, the table top 60 and upper step 40 may have complimentary components (66 and 46, respectively) that engage one another to secure the table top 60 to the upper step 40. Preferably, the locking mechanism provides enough stability so that the table top 60 remains attached to the upper step 40 under moderate force so that the child's use of the furniture 10 as a desk or workspace is uninterrupted by the forces a child may typically exert on a desk/workstation during normal use.

The locking mechanism may be provided as complimentary components on the table tap 60 in some embodiments, such as in the embodiment shown in FIGS. 1-2 and 3*a-b*. In the illustrated embodiment, the table top 60 may include a protrusion 66 that engages a recess or aperture 46 in the upper step 40, thereby securing the table top 60 to the upper step. As best shown in FIG. 3B, the protrusion 66 may extend between about 0.2 inches and about 0.75 inches, preferably between about 0.3 inches and about 0.5 inches. In the illustrated embodiment, the protrusion extends about 0.375 inches.

Figure 6A:
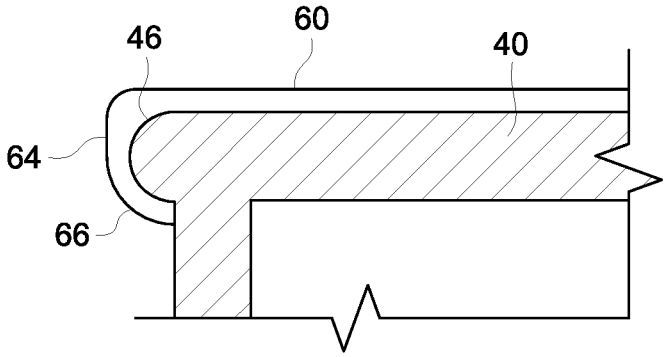
FIGS. 6A-B show cutaway views of portions of exemplary table top portions of the exemplary convertible furniture piece of FIG. 1.
Figure 6B:
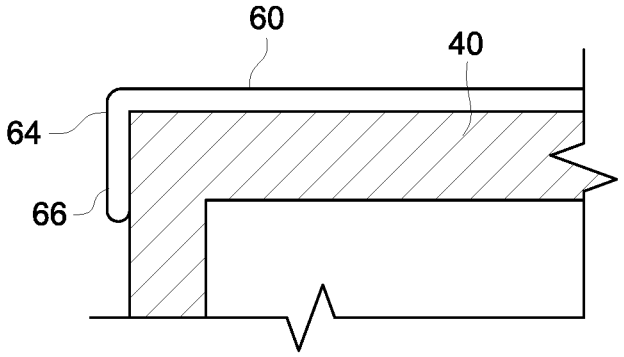

Optionally, the upper step 40 and the table top 60 may each include metal or other ferromagnetic material for cooperating with a magnet disposed in the other to be used in combination to secure the table top 60 to the upper step 40. Other mechanism may also be used to fasten the table top 60 to the upper step 40. For example, as shown in FIG. 6*a*, the upper step 40 may include a curved or otherwise protruding edge that may be engaged by a lip portion 64 of the table top 60. In some embodiments, the lip portion 64 may directly engage a square edge of the upper step 40, as shown in FIG. 6*b*. In such embodiments, the surface of the upper step 40 may have a coefficient of friction that impedes movement of table top 60 placed thereon, or magnetic and/or ferromagnetic materials may be disposed in the upper step 40 and/or table top 60 to secure the two to one another. Other mechanisms for removably attaching the table top 60 to the upper step 40 also may be used.

7.0 Exemplary Storage Slots 40

Figure 4:
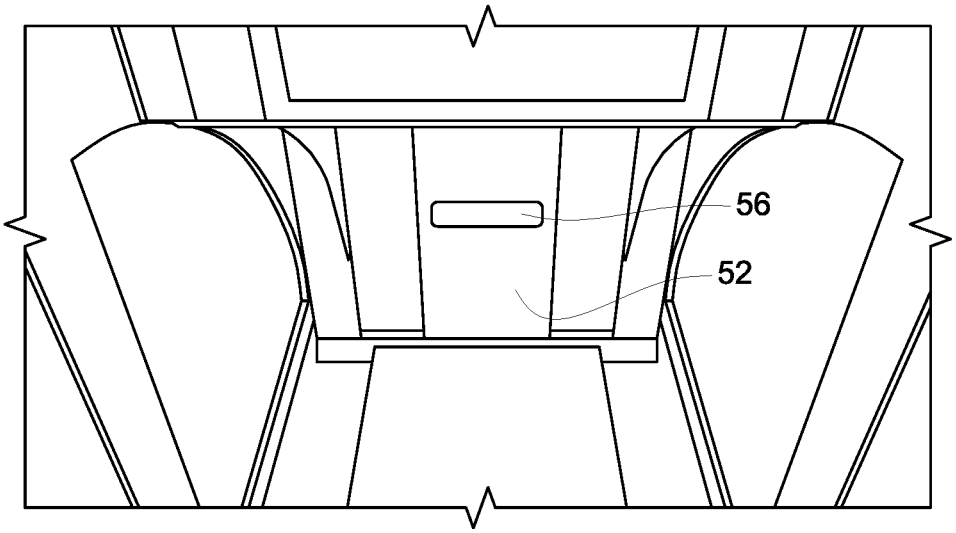
FIG. 4 shows an exemplary storage slot of an exemplary convertible furniture piece.
Figure 5A:
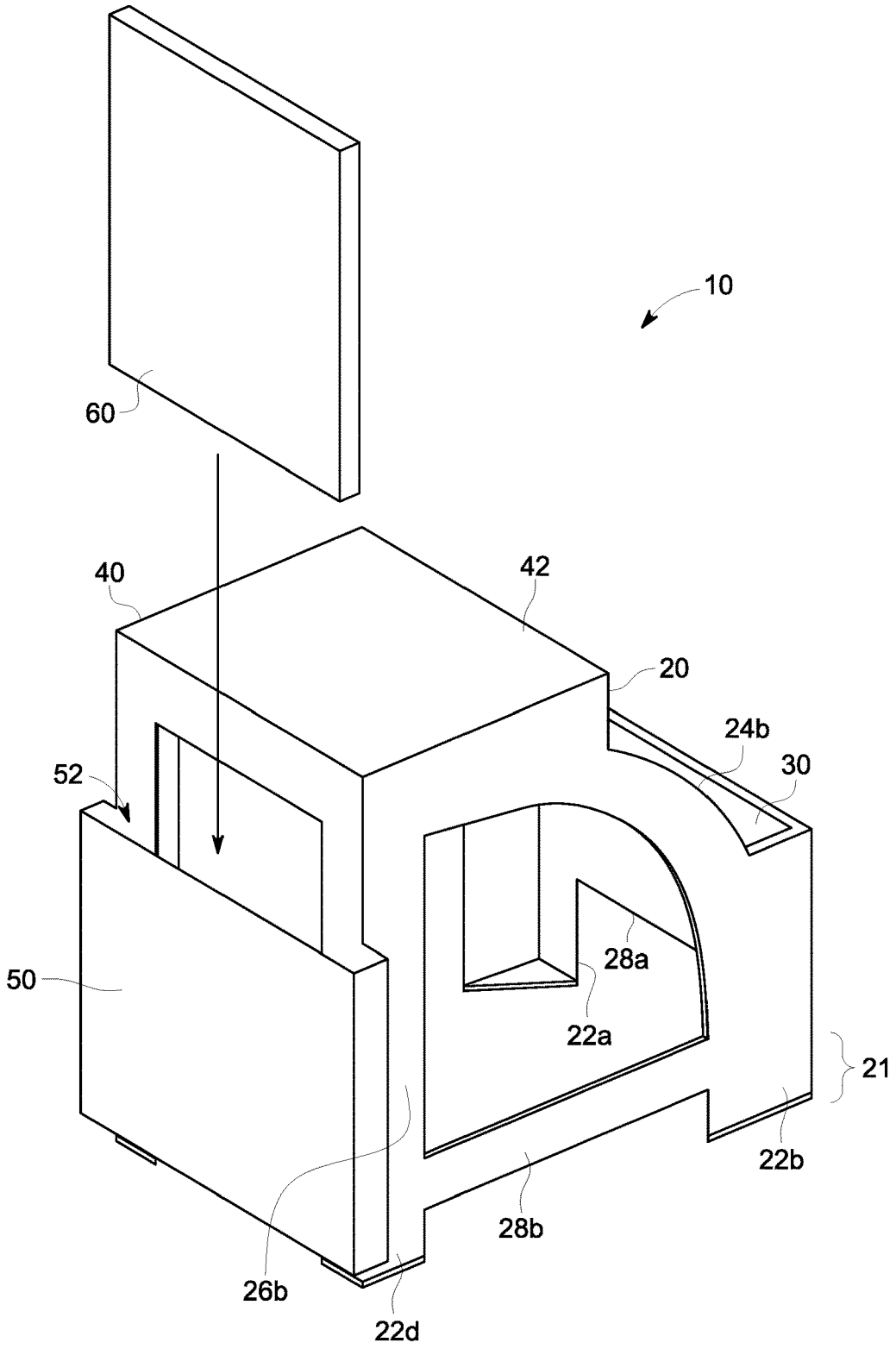
FIG. 5A-B shows perspective views of another exemplary convertible furniture piece.
Figure 5B:
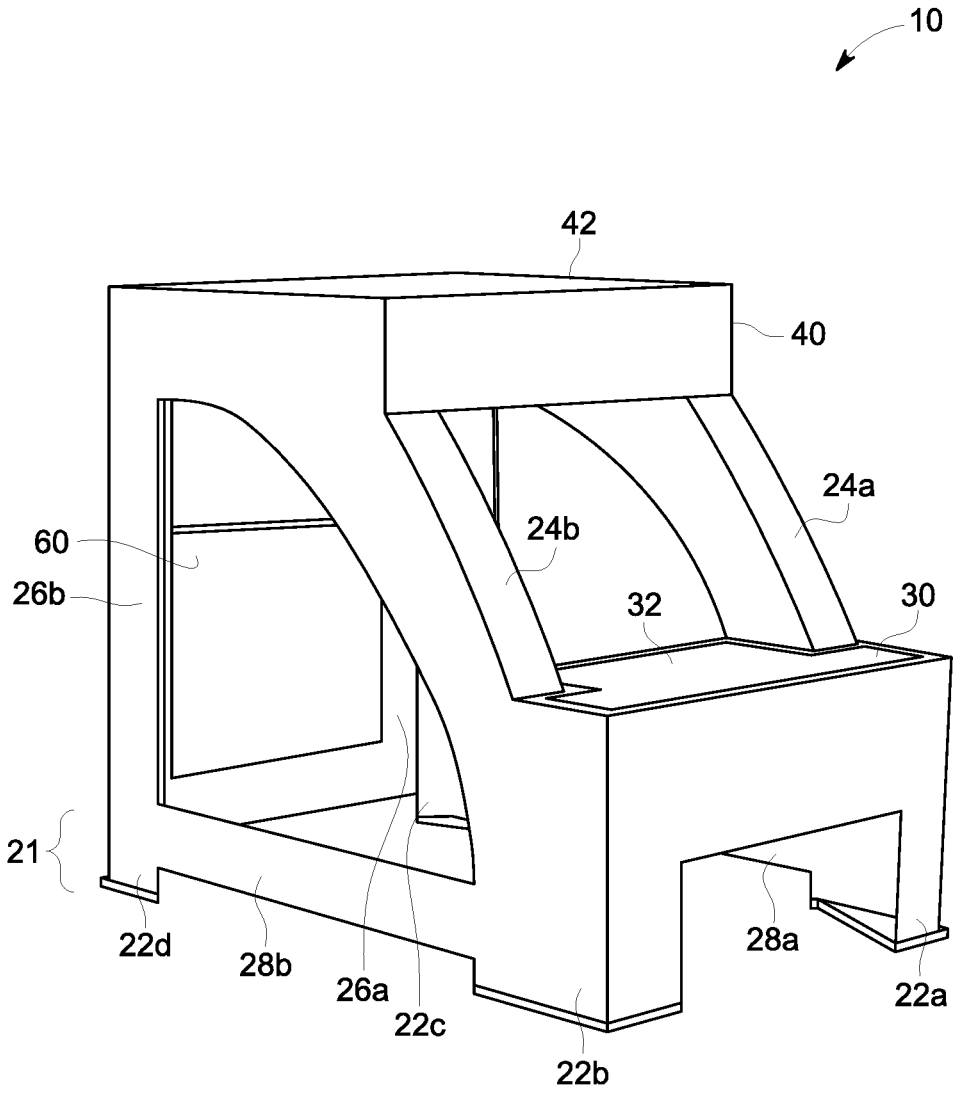

FIG. 4 shows an exemplary storage slot 50 of an exemplary convertible furniture piece 10. As shown, the slot 50 may accommodate the table top 60 for safe keeping when the piece 10 is being used as a step stool. In the illustrated embodiment, the storage slot may be disposed in the upper step 40 and may include one or more support surfaces 52 upon which the table top 60 may rest when being stored in the slot 50. Optionally, the slot 50 may include a locking mechanism 56 similar to that provided on the upper step 40 so that the table top 60 is securely kept in the slot 50. In the illustrated embodiment, the locking mechanism 56 is an aperture for receiving protrusion 66. Alternatively, or additionally, the storage slot 50 may be disposed elsewhere on the convertible furniture piece 10, such as between two legs 22*c* and 22*d* as shown FIG. 5A-B. Such a configuration may accommodate table tops 60 that are wider and/or longer than the upper step 40.

While various embodiments of the invention have been described, it will be apparent to those of ordinary skill in the art that many more embodiments and implementations are possible within the scope of the invention. Accordingly, the invention is not to be restricted except in light of the attached claims and their equivalents.

I claim:

1. A convertible furniture piece comprising:

a base portion that defines a footprint;

an upper step attached to the base portion, the upper step disposed substantially within the footprint;

an intermediate step attached to the base portion, the intermediate step disposed vertically between the upper step and the base so as to define an opening between the upper step and the intermediate step; and a table top removably attachable to the upper step.

2. The convertible furniture piece of claim 1, where the upper step and the table top each include complimentary components of a locking mechanism that engage one another when the table top is removably attached to the upper step.

3. The convertible furniture piece of claim 2, where the table top includes a protrusion and the upper step includes an aperture for receiving the protrusion.

4. The convertible furniture piece of claim 1, where the upper step includes a storage slot for storing the table top.

5. The convertible furniture piece of claim 1, further comprising a textured upper surface provided on either the upper step, the intermediate step, or both.

6. The convertible furniture piece of claim 1, where the upper step is fixedly attached to the base and the intermediate step.

7. The convertible furniture piece of claim 6, where the base, upper step and intermediate step are formed as a unitary structure.

8. The convertible furniture piece of claim 7, where the unitary structure is plastic.

9. The convertible furniture piece of claim 1, where the table top includes an upper surface made of either a chalkboard material, a whiteboard material, or both.

10. The convertible furniture piece of claim 1, where the intermediate step is disposed substantially within the footprint.

11. A convertible furniture piece comprising:

a base portion that defines a footprint;

an upper step fixedly attached to the base portion, the upper step disposed substantially within the footprint;

an intermediate step fixedly attached to the base portion, the intermediate step disposed vertically between the upper step and the base; and a table top removably attachable to the upper step, where the upper step and the table top each include complimentary components of a locking mechanism that engage one another when the table top is removably attached to the upper step, and where the base portion, the upper step and the intermediate step are formed as a unitary structure.

12. The convertible furniture piece of claim 11, where the table top includes a protrusion and the upper step includes an aperture for receiving the protrusion.

13. The convertible furniture piece of claim 11, where the upper step includes a storage slot for storing the table top.

14. The convertible furniture piece of claim 13, where the storage slot includes an aperture for engaging a protrusion provided on the table top.

15. The convertible furniture piece of claim 11, further comprising a textured upper surface provided on either the upper step, the intermediate step, or both.

16. The convertible furniture piece of claim 11, where the table top includes an upper surface made of either a chalkboard material, a whiteboard material, or both.

17. A convertible furniture piece comprising:

a body including:

a base portion that defines a footprint, the body including a storage slot including a support surface having an aperture;

an upper step fixedly attached to the base portion, the upper step disposed substantially within the footprint and including an aperture, the upper step including an aperture; and an intermediate step fixedly attached to the base portion, the intermediate step disposed vertically between the upper step and the base; and a table top removably attachable to the upper step, the table top including a protrusion, where the storage slot is adapted to receive the table top and where the aperture in the support surface of the storage slot and the aperture in the upper step are each adapted to receive the protrusion of the table top.

18. The convertible furniture piece of claim 17, where the body is formed as a unitary plastic structure.

19. The convertible furniture piece of claim 17, further comprising a textured upper surface provided on either the upper step, the intermediate step, or both.

20. The convertible furniture piece of claim 17, where the table top includes an upper surface made of either a chalkboard material, a whiteboard material, or both.

* * * * *